US007905504B2

(12) United States Patent
Suddaby et al.

(10) Patent No.: US 7,905,504 B2
(45) Date of Patent: Mar. 15, 2011

(54) SEAT

(75) Inventors: Thomas Paul Suddaby, Newent (GB); Sean Patrick Nelson, Wrexham (GB)

(73) Assignee: Specmat Limited, Herefordshire (GB)

( * ) Notice: Subject to any disclaimer, the term of this patent is extended or adjusted under 35 U.S.C. 154(b) by 104 days.

(21) Appl. No.: 12/429,074

(22) Filed: Apr. 23, 2009

(65) Prior Publication Data

US 2009/0267315 A1 Oct. 29, 2009

(30) Foreign Application Priority Data

Apr. 28, 2008 (GB) ..... 0807684.6

(51) Int. Cl.
*B42M 1/14* (2006.01)
*A61G 5/00* (2006.01)

(52) U.S. Cl. ..... 280/250.1; 280/304.1; 297/343

(58) Field of Classification Search ..... 297/340, 297/341, 353, 343; 280/304.1, 250.1
See application file for complete search history.

(56) References Cited

U.S. PATENT DOCUMENTS

| | | | | |
|---|---|---|---|---|
| 4,411,469 | A * | 10/1983 | Drabert et al. | 297/300.2 |
| 6,425,635 | B1 * | 7/2002 | Pulver | 297/343 |
| 6,540,296 | B1 * | 4/2003 | Shats et al. | 297/353 |
| 6,969,116 | B2 * | 11/2005 | Machael et al. | 297/300.2 |
| 2005/0017560 | A1 * | 1/2005 | Bastas | 297/353 |
| 2006/0103221 | A1 * | 5/2006 | Kleist | 297/440.15 |
| 2010/0164266 | A1 * | 7/2010 | Walters et al. | 297/337 |

* cited by examiner

*Primary Examiner* — Tony H. Winner
(74) *Attorney, Agent, or Firm* — Kilpatrick Townsend and Stockton LLC

(57) ABSTRACT

A seat (14), particularly but not exclusively for a wheelchair, comprises a bottom rest (13, 60), a back rest support (18) rotatable relative to the bottom rest about an axis of rotation (100); and a back rest (22) slidably mounted on the back rest support and moveable therealong to vary its position relative to the bottom rest. The back rest is kinematically linked to the bottom rest such that the back rest moves nearer to the axis of rotation as the angle between the back rest support and the bottom rest increases.

15 Claims, 8 Drawing Sheets

SEAT

TECHNICAL FIELD

The present invention relates to seating, in particular but not exclusively a seat for a wheelchair.

BACKGROUND ART

FIG. 1 shows a wheelchair 10 of the kind known from WO2006/106324 and EP1348414 and comprising a chassis 12 with a seat framework 14 mounted thereon, the seal framework 14 comprising base plates 60 and a pair of upright elongate frame members 18. Base plates 60 carry a bottom rest 13 and leg rests 15, while frame members 18 carry inter alia a head rest 20, a back rest 22, armrests 23 and thoracic supports 24. The rest elements 13,15,20,22,23 and 24 together form a postural management system, the thoracic supports 24 supporting a child's upper torso to assist prevention, if not correction, of spinal deformities.

FIGS. 2 and 3 are side and detail views of the wheelchair disclosed in EP1348414.

FIG. 2 shows schematically how the seat framework 14 is attached to a chassis 12. Plates 60 are rotatably mounted on a support beam 16, a mounting bracket 62 being provided to centre the seat framework 14 on the chassis 12.

Plates 60 extend rearwardly of the support beam 16 and a rearward portion 64 of each is coupled to a respective end of a tube 66. The tube 66 is supported by a variable length strut 68 which is mounted on bracing member 32. The strut 68 is pivotally mounted at each end and comprises a rod 70 which is a sliding lit in housing 72. A foot pedal 74 operates a locking mechanism (not shown) in housing 72 which allows the rod 70 to move relative to the housing 72 when the foot pedal 74 is operated. With the foot pedal 74 depressed, the seat framework 14 is free to rotate in direction arrow A around the support member 16.

FIG. 2 shows schematically some detail of the backrest 130 of seat member 14, the position of which may he adjusted from an upright position to an inclined position (shown in phantom lines). The back rest 130 is adjustably mounted via bracket 132 to the rearward portion 64 of plates 60. The rearward portion 64 includes three arcuate slots each for receiving a bolt (not shown) securing bracket 132 to the tube 66 extending between plates 60. The position of each bolt within its respective slot 134 is determined by the position of arm 136 relative to the rearward portion 64 of plates 60. A plurality of apertures 138 is provided in the rearward portion 64 which are selectably registrable with apertures 140 in arm 136. The inclination of the back rest 130 is thus determined by selecting which of apertures 138 are registered with apertures 140 in the arm 136. Once the appropriate apertures are registered, a locking pin (not shown) may be used to secure the desired back rest inclination. Such adjustment is typically carried out by a healthcare professional rather than when the chair is in use.

However, the present inventors have established mat if aback rest is reclined relative to a seat member (i.e. when the angle between the back rest and the seat member increases) when the seat is occupied, the seat occupant's clothing is pulled upwards at the back, making the occupant uncomfortable. This will be referred to hereafter as the 'shirt pull effect'. Where the seat incorporates a thoracic support, this also moves upwards relative to the occupant's body, spoiling the positioning of the support and the associated postural management.

The present invention has as an objective the mitigation of the aforementioned problems.

DISCLOSURE OF INVENTION

According to the present invention, there is provided a:

seat comprising:

a bottom rest, a back rest support rotatable relative to the bottom rest about an axis of rotation, the back rest support and bottom rest defining an angle therebetween; and a back rest slidably mounted on the back rest support and moveable therealong to vary its position relative to the bottom rest;

the back rest being kinematically linked to the bottom rest such that the back rest moves nearer to the axis of rotation as the angle between the back rest support and the bottom rest increases.

Kinematic linkage of tire back rest to the bottom rest means that movement of the bottom rest relative to the back rest support will result in movement of the back rest relative to the back rest. A back rest that moves downwards (i.e. nearer to the axis of rotation) as it reclines (i.e. as the angle between the back rest and the bottom rest increases) reduces or even offsets completely the increase in separation between the point of contact of the occupant with the bottom rest and the point of contact of the occupant with the back rest as the back rest is inclined relative to the bottom rest. Such an increase in separation would otherwise result in the aforementioned shirt-pull effect. Where, for example, the seat occupant was wearing a shirt tucked into trousers, such an increase would result in the shirt being pulled out of the trousers.

According to one embodiment, the back rest may be kinematically linked to the bottom rest by a rigid link pivotally attached at a first end to the back rest and at a second end to the bottom rest.

According to another embodiment, the back rest may be kinematically linked to the bottom rest, by a jointed linkage. The jointed linkage may comprise a lower link, attached at a first end to the bottom rest, and an upper link, pivotally attached at a first end to the back rest and at a second end to the second end of the lower link.

The seat may comprise a locking mechanism configured to releasably fix the angle between the back rest support and the bottom rest. The locking mechanism may comprise an adjustable length strut attached at a first end to the bottom rest and at a second end to the back rest support. The first end of the adjustable length strut may be attached to the bottom rest by a coupling configured to be releasable in the course of normal operation of the seat.

In another embodiment, the aforementioned lower link may be kinematically linked to the back rest support and the locking mechanism may comprise an adjustable length strut pivotally attached at a first end to the bottom rest and a second end to the lower link. The lower link may be kinematically linked to the back rest support by a further link pivotally attached at a first end to the lower link and at a second end to an arm rigidly attached to the back rest support and extending radially from the axis of rotation.

The rigid link or jointed linkage may be configured to pass underneath the axis of rotation.

The seat may comprise a leg rest pivotable relative to the bottom rest, the seat being configured to decrease the angle of the leg rest relative to the bottom rest as the angle between the back rest and the bottom rest increases. The leg rest may be kinematically linked to the back rest support via the rigid link or jointed linkage.

According to another aspect of the present invention, there is provided a seat having a back rest and a bottom rest, the back rest being rotatable relative to the bottom rest about an axis of rotation; the seat being configured to move the back rest nearer to the axis of rotation as the angle between the back rest and the bottom rest increases. The seat may comprise a back rest support for said back rest, the back rest support being rotatable relative to the bottom rest about the axis of rotation and the back rest being moveable along the back rest support in a radial direction relative to said axis. The back rest may be kinematically linked to the bottom rest, i.e. movement of the bottom rest relative to the back rest support results in movement of the back rest relative to the back rest support.

The invention also provides a wheelchair comprising a chassis with ground-engaging wheels and, mounted thereon, a seat as set out above. The seat may be pivotable relative to the chassis. The wheel chair may have a handle for pushing the wheelchair along, the handle being attached to the back rest of the seat such that the handle moves nearer to the axis of rotation of the back rest as the angle between the back rest and the bottom rest increases.

BRIEF DESCRIPTION OF DRAWINGS

An embodiment of the invention will now be described by way of example with reference to the accompanying drawings, in which.

DETAILED DESCRIPTION OF SPECIFIC EMBODIMENTS

Figure 4:
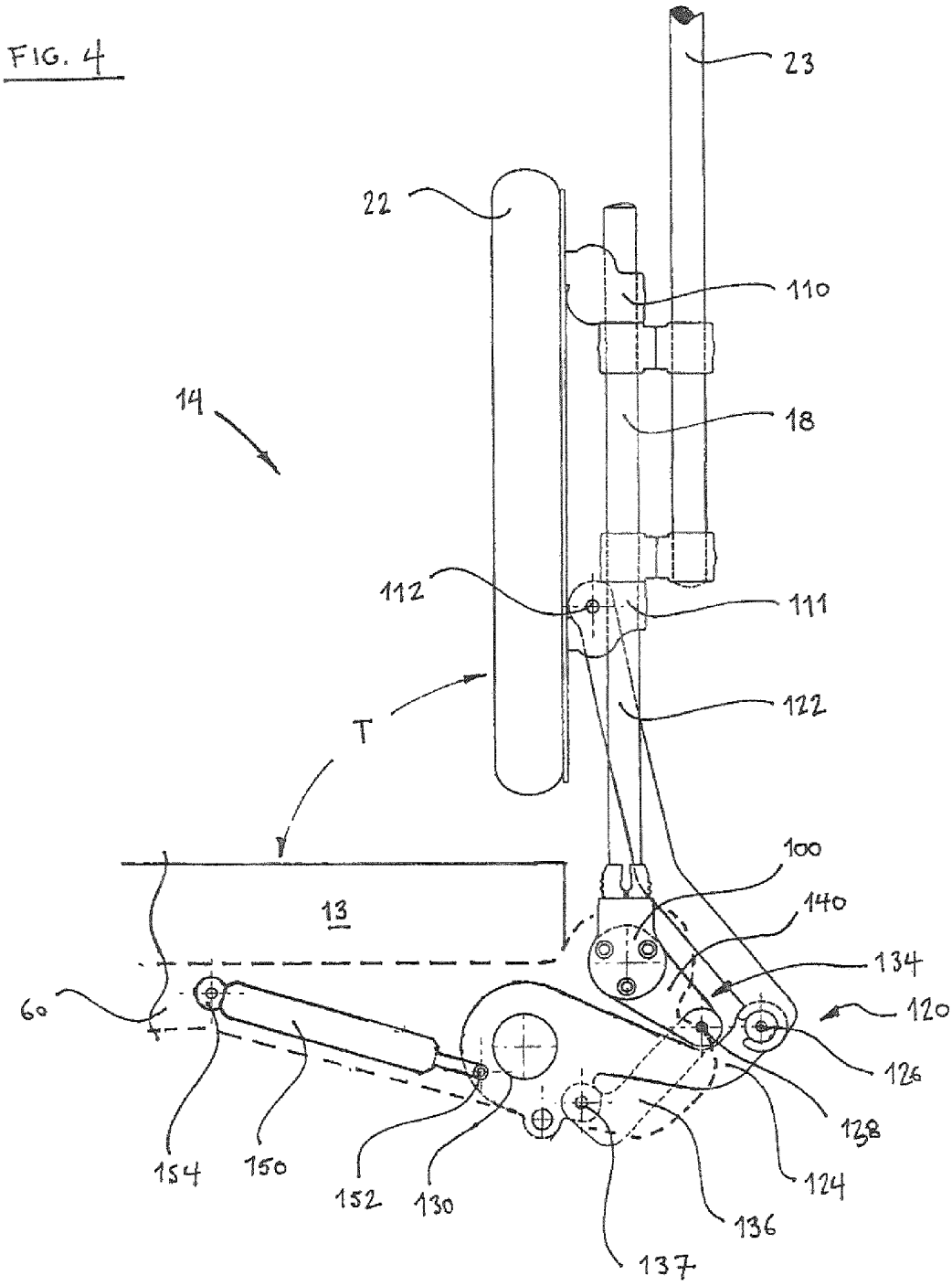
FIG. 4 is a side view of an embodiment of a seat according to the present invention.

FIG. 4 is a side view of a first embodiment of a seat according to the present invention when in a first, upright position. The seat is mounted on a chassis of the kind shown in FIGS. 1 and 2 to form a wheelchair. The seat may be pivoted relative to the chassis about a mounting bracket as indicated at 62 in FIG. 2.

Figure 1:
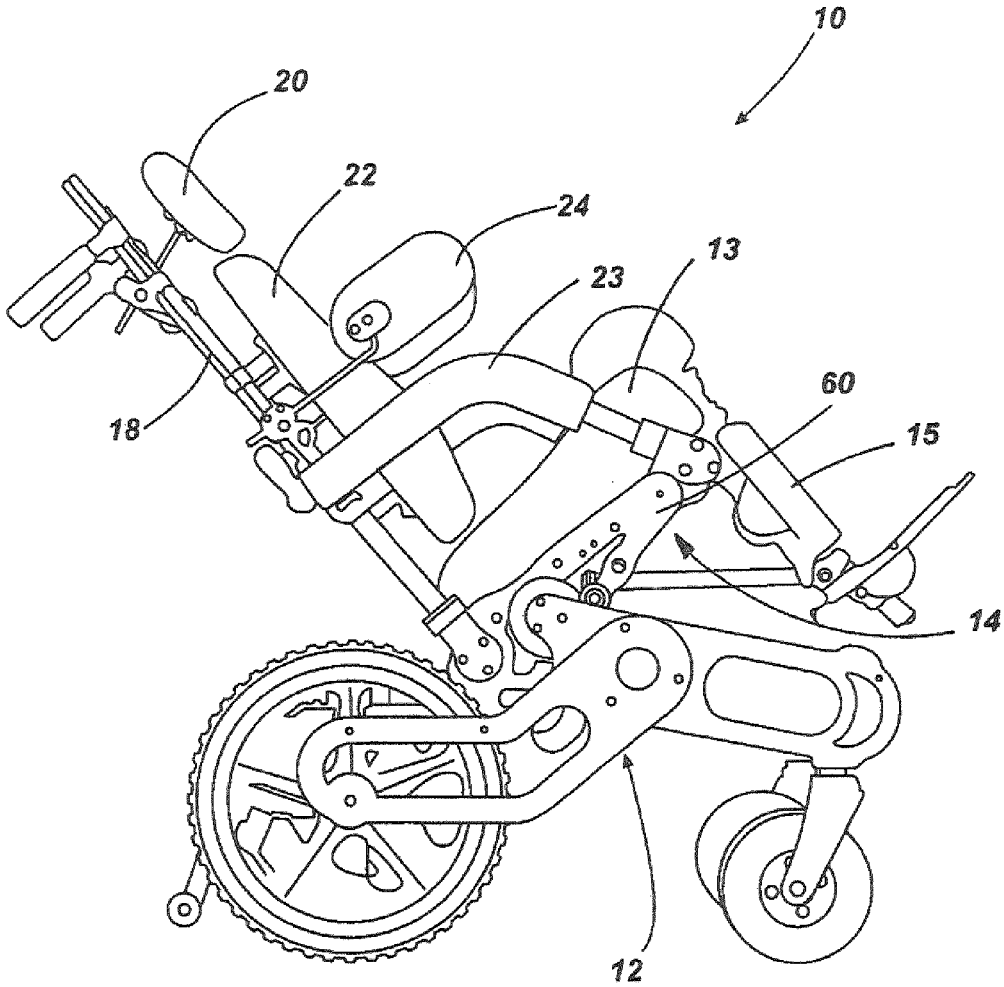
FIG. 1 is a side view of a wheelchair of the kind known from WO2006/106324 and EP1348414.
Figure 2:
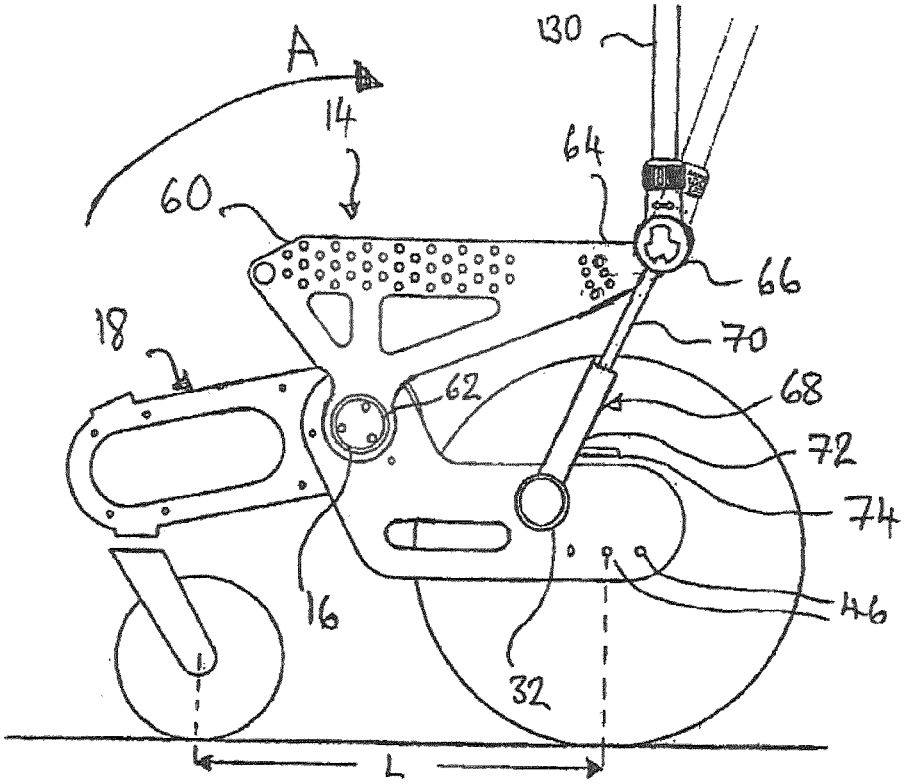
FIG. 2 is a schematic sectional view of a wheelchair according to EP1348414.
Figure 3:
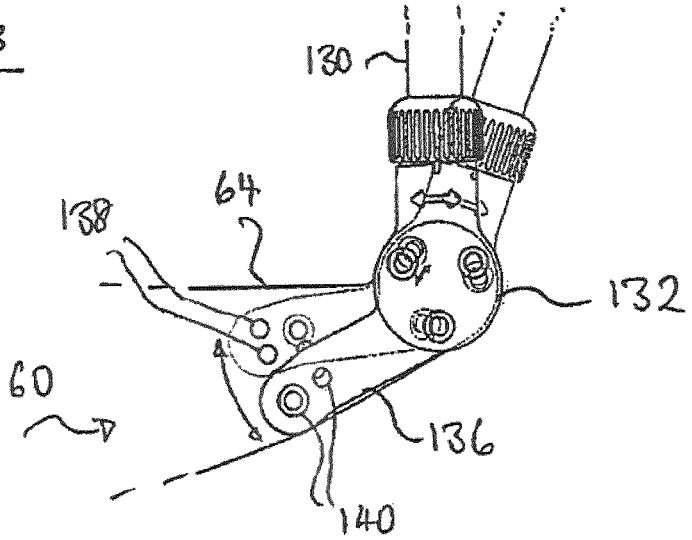
FIG. 3 shows detail of backrest tilt adjustment of the wheelchair of FIG. 2.

As in the embodiments of FIGS. 1-3, seat framework 14 comprises base plates 60 (shown in dashed lines) and a pair of upright elongate frame members 18. Base plates 60 carry a bottom rest 13 while frame members 18 carry a back rest 22 and, typically, a head rest and thoracic supports (not shown).

Frame members 18 are mounted to the rear of the base plates 60 by means of a pivot 100, thereby allowing the back rest 22 to be reclined relative to the bottom rest 13 and increasing the angle T between the back rest 22 and the bottom rest 13. A handle 23 for pushing the wheelchair is also attached to the back rest.

To reduce the 'shirt pull effect', back rest 22 is provided with upper and lower guides 110 and 111 which slidably engage the frame members 18, allowing the back rest 22 and handle 23 to slide up and down the frame members 18. Although not shown, thoracic supports of the kind discussed above with regard to the prior art wheelchair of FIG. 1 may also he attached to the back rest 22 or handle 23 such that they also slide up and down.

The position of the back rest 22 along the frame members 18 is determined by a linkage 120 connected between the base plates 60 and the back rest 22. In the example shown, the linkage is connected via pivot 112 to the lower guide 111 of the backrest 22.

Figure 5:
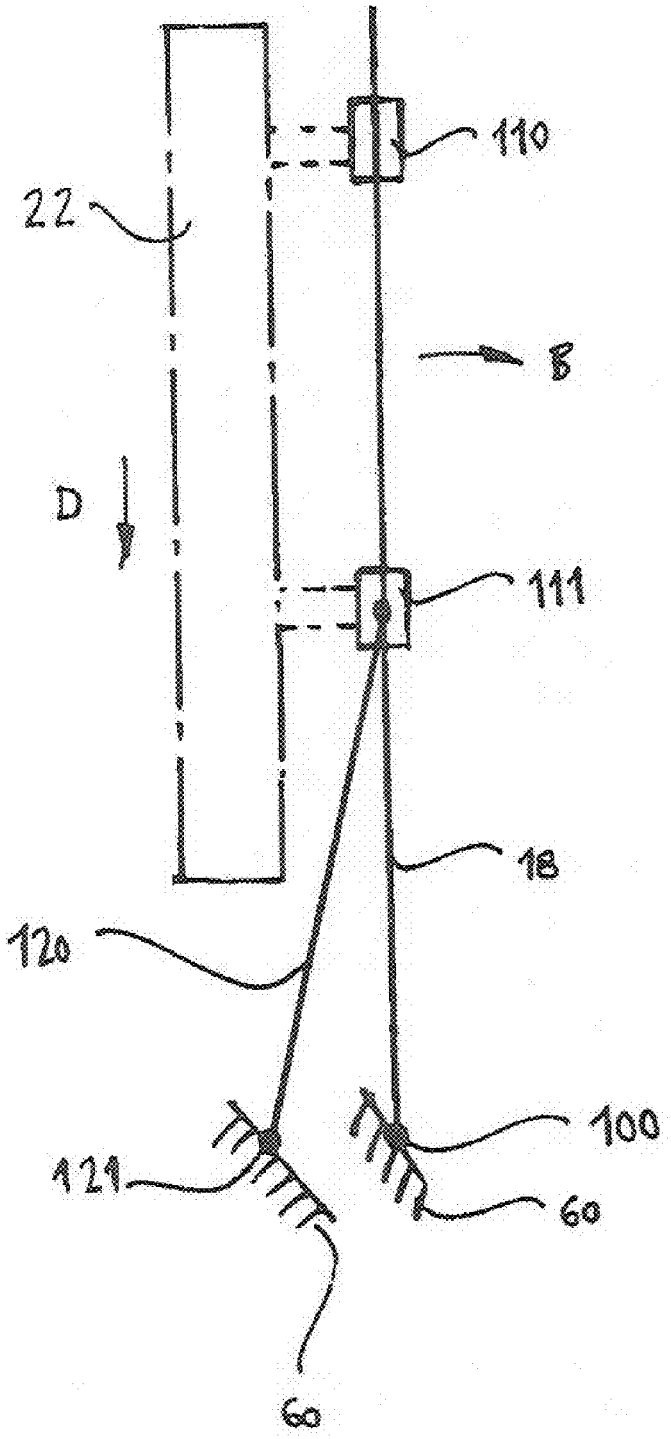
FIG. 5 is a diagram showing the operation of a seat according to the present invention.

As illustrated by the diagram of FIG. 5, attachment of the lower end of a linkage 120 to a pivot 121 on the seat framework in front of the pivot 100 results in the back rest 22 being pulled on its guides 110,111 down the frame members 18 in a radial direction D when the frame members 18 are reclined backwards (as indicated by arrow B), thereby reducing the 'shirt pull effect'.

Such a linkage whereby movement of one end of the linkage (in this case movement of the base plates 60 relative to the frame members 18) results in movement of the other end of the linkage (in this case the back rest 22 relative to the frame members 18) is known as a kinematic linkage and elements at either end of the linkage are said to be kinematically linked. It will be appreciated that such kinematic linking can be effected by means other than the rigid links used in the described embodiment, for example gear trains, chains or belts.

It will be appreciated that, particularly when the seat is fully reclined, a straight linkage 120 of the kind shown in FIG. 5A might encroach into the space between the back rest 22 and bottom rest 13, spoiling the comfort of the seat occupant.

Accordingly, in the particular embodiment of FIG. 4, linkage 120 comprises upper and lower links 122 and 124 pivoted together at pivot 126. Upper link 122 is attached to the seat back guide 111 at pivot 112, while lower link 124 is attached to the base plates 60 at pivot 130. Such a linkage 120 adopts a dog leg or 'V' shape, allowing it to sit behind the bottom and back rests 13 and 22 and out of the way of the seat occupant, especially if lower pivot 130, in addition to being located forward of the Same member pivot 100, is also located below the pivot 100.

Lower link 124 is also connected to the frame members 18 via a further linkage 134 comprising a second lower link 136 connected at one end 137 to lower link 124 and at the other end (via pivot 138) to an arm 140 rigidly fixed to the frame members 18.

The angular position of the frame members 18 is controlled by a lockable strut 150 pivotally attached at one end 152 to the link 124 and at the other end 154 to the base plates 60. As is well known and thus not illustrated, a control (e.g. a press brake style lever on the handle 23) allows the length of the strut 150 to be locked, thereby preventing rotation of the lower link 124. Unlocking the strut allows the length of the strut to be increased or decreased, typically under the action of a gas spring, allowing the lower link 124 to rotate and the angular position of the frame members 18 to change.

Figure 6:
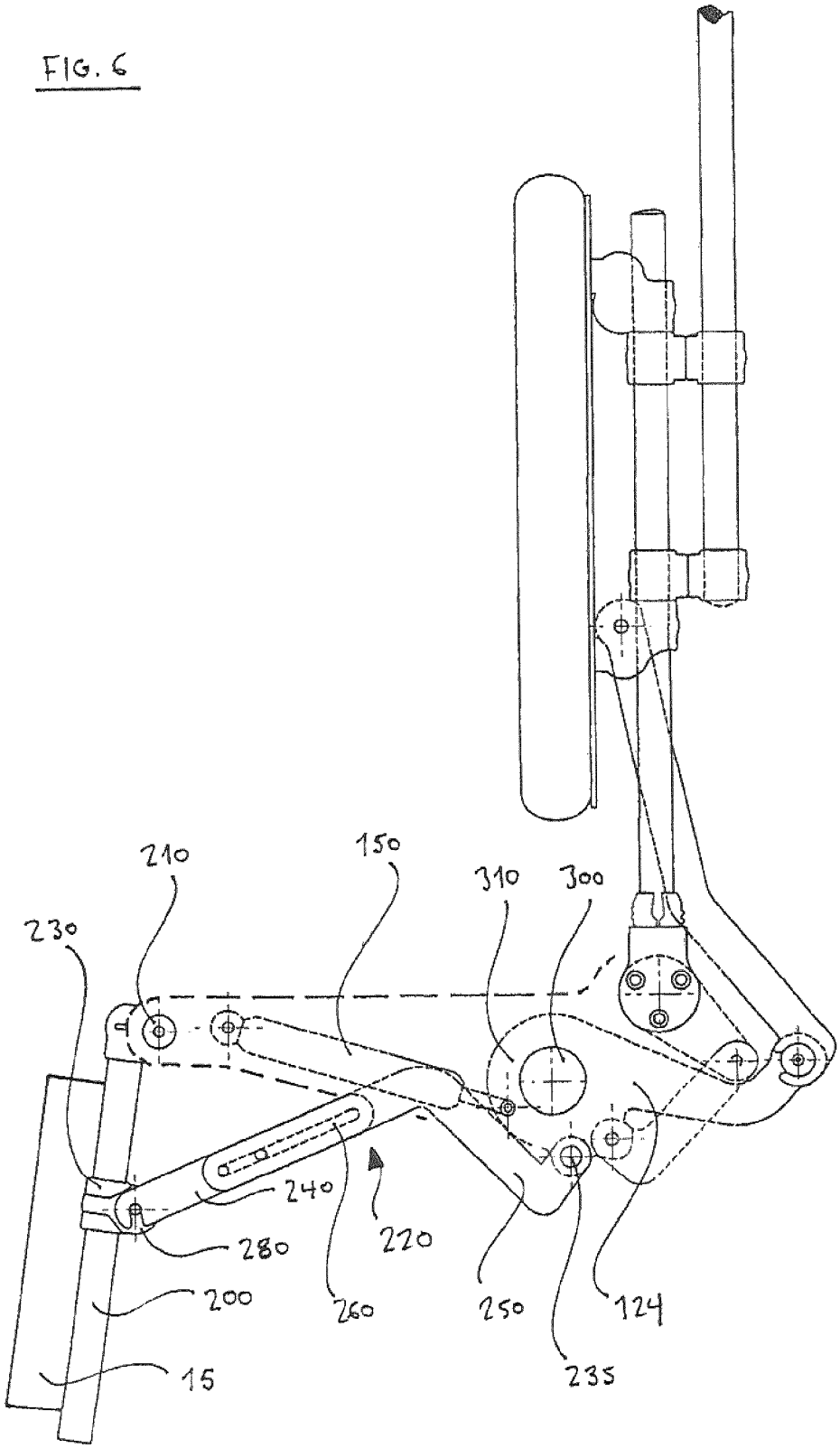
FIG. 6 is a side view of the embodiment of FIG. 4 including additional detail.

In addition to varying the inclination of the back rest, it may also be desirable to vary the inclination of the leg rests in a complementary manner and FIG. 6 shows an embodiment having such functionality.

A leg rest 15 is attached to a support member 200 which itself is pivotally mounted to the front of the base plates 60 by pivot 210. The inclination of the leg rest is controlled by a further link 220 attached at one end to the support member via a bracket 230 and at the other end to lower link 124 at pivot 235. It will be evident that, in locking the rotational position of the link 124, the strut 150 also locks the rotational position of support member 200 and thus the angle of inclination of the leg rest 15.

The further link 220 is shaped, e.g. with multiple dog legs, so as to avoid other seat components. The further link may also comprise two parts 240,250, joined by fasteners passing through slots 260 in each part, so as to allow the length of the further link to be adjusted as is known per se. Adjusting the length allows the angle of the leg rest relative to the back rest to be varied, while adjusting the position of the bracket along the support member allows the rate of variation of leg rest angle to the changed. It will be understood that right and left leg rests are individually variable in both angle and rate. The further link 220 is connected to the bracket by means of a latch 280 which can be released to allow the leg rest 15 to swing away.

As shown in FIG. 6, link 124 is advantageously pivoted around the wheelchair main support beam 300, with the pivots 132, 152 and 235 being located on a flange 310 of the link 124 surrounding that beam.

Figure 7:
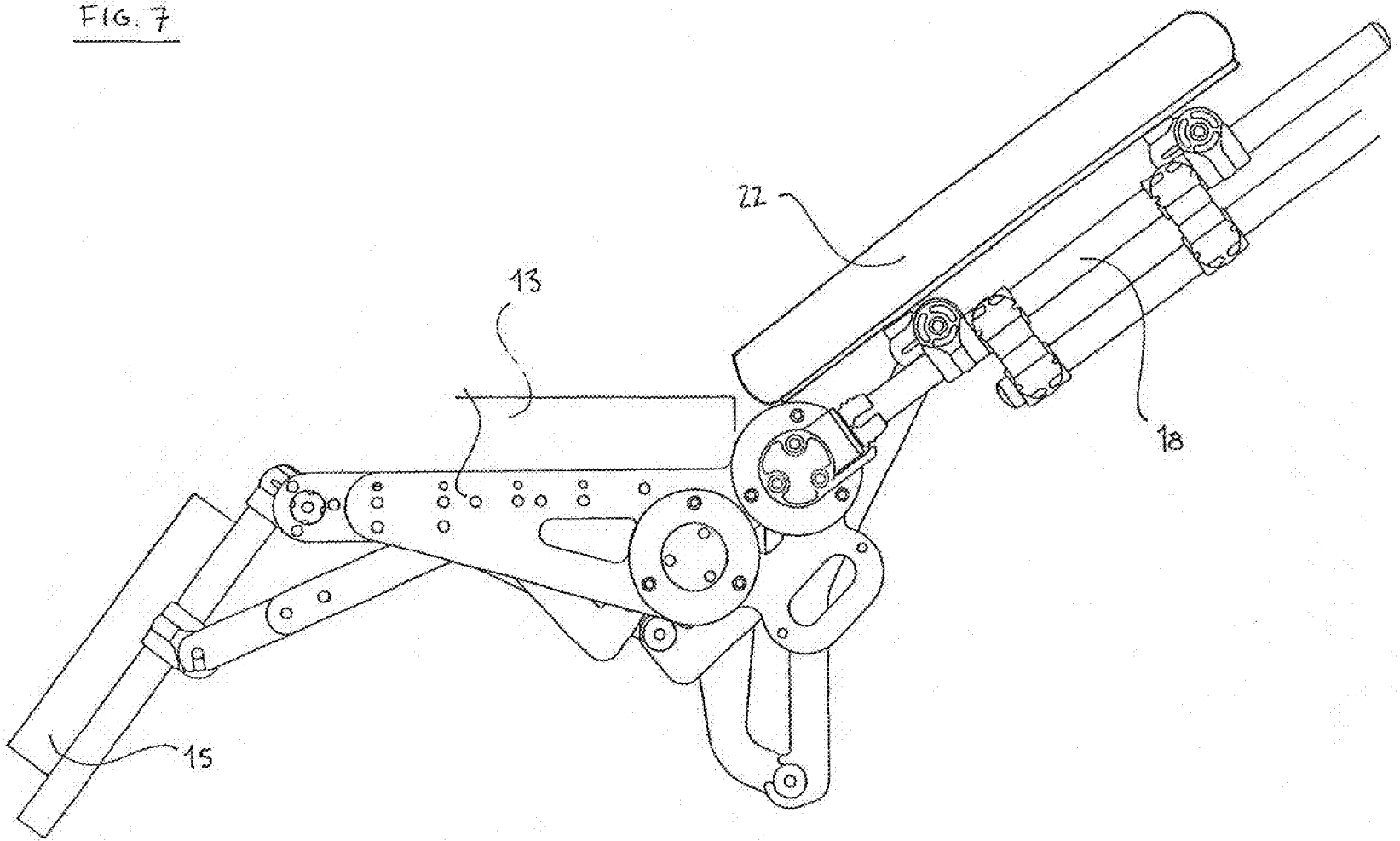
FIG. 7 is a side view of the embodiment of FIGS. 4 and 6 when in a fully reclined position.

FIG. 7 is a side view of the seat of FIGS. 4 and 6 in a fully reclined position. Compared to the upright position of FIGS. 4 and 6, it will be seen that back rest 22 has slid down frame members 18 towards bottom rest 13. Leg rest 15 has correspondingly rotated upwards.

Figure 8:
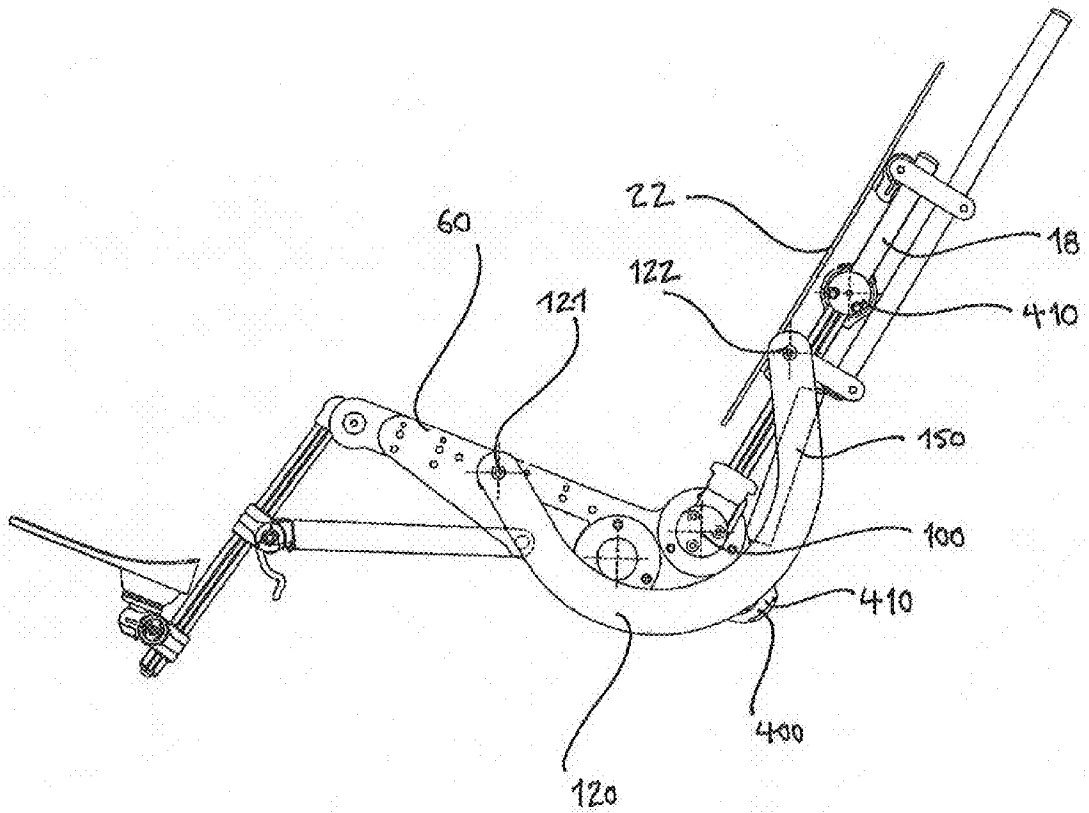
FIG. 8 is a side view of a second embodiment of the invention.

FIG. 8 shows a second embodiment of the invention in which the back rest 22 is kinematically linked to the bottom rest and supporting base plates 60 by a rigid link 120 attached at first and second ends thereof by pivots 122 and 121 respectively. To avoid the mechanism encroaching into fee space between the back rest 22 and bottom rest 13, as mentioned above with regard to FIG. 5, rigid link 120 is shaped in the form of a "U" such that it passes beneath the axis about which back rest support frame members 18 rotate relative to the bottom rest base plates 60.

In the embodiment of FIG. 8, the rotation of the back rest is controlled by a lockable strut 150 mounted between the seat base frame (specifically a cross member 400 extending between the rear of the base plates 60) and the seat back frame (specifically a cross member 410 extending between upright elongate frame members 18). Cross member 410 is releasably attached to the elongate frame members 18, e.g. by releasable clamps, such that the position of the cross member 410 along the length of the frame members may be adjusted. This in turn allows the maximum recline angle of the members 18 of the seat back frame—corresponding to the minimum contracted position of the stmt 150—to be adjusted.

The lower end of the strut 150 may be attached to cross member 400 by means of a coupling 410 which can be released during normal operation of the seat, allowing the entire seat back (including frame members 18, handle 23 and backrest 22) to be folded forward against the seat base frame (including base frame members 60 and bottom rest 13), thereby facilitating storage or transport of the wheelchair.

Figure 9:
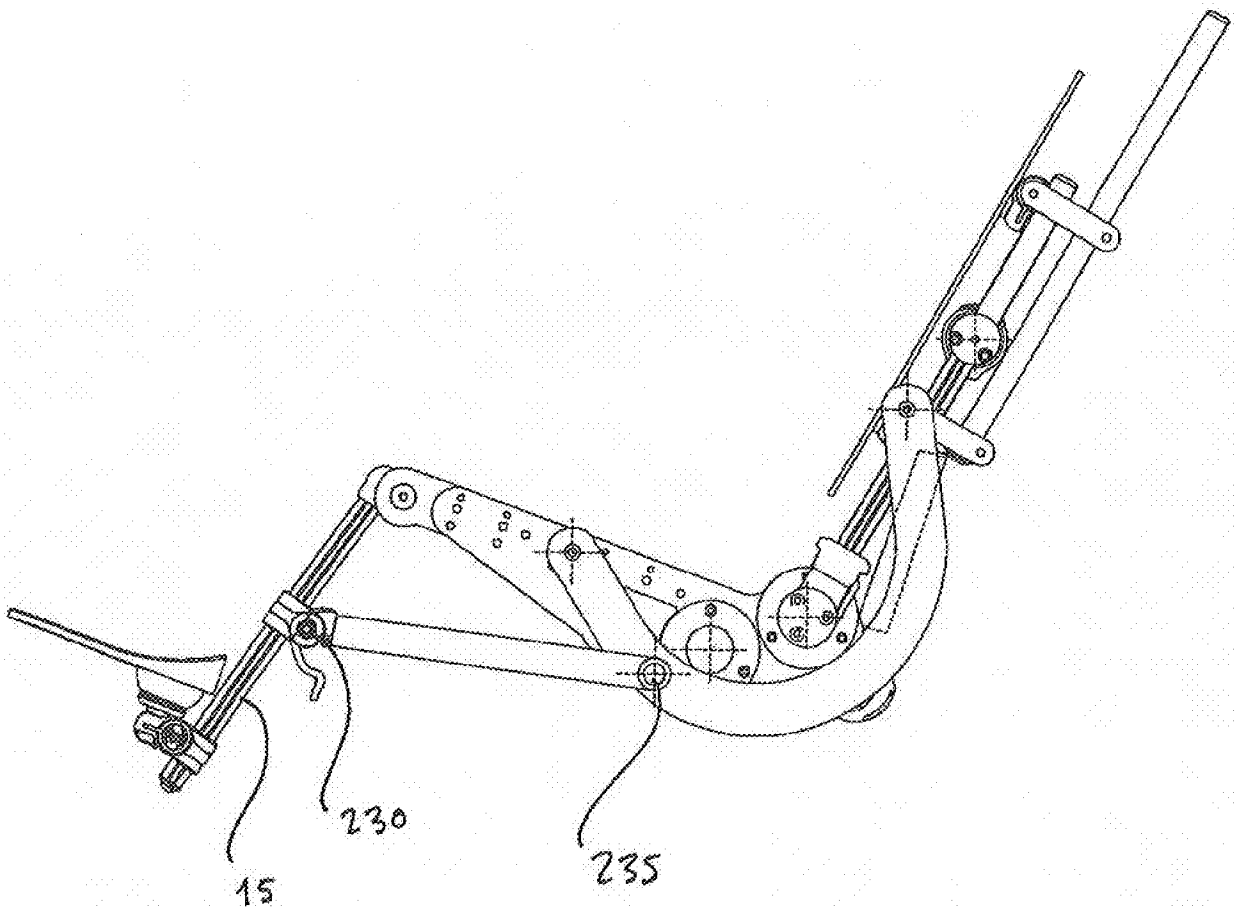
FIG. 9 is a side view of a third embodiment of the invention.

FIG. 9 shows a further embodiment incorporating the mechanism of FIG. 8 and additionally enabling variation of the angle of the leg rests with variation of the angle of the back rest, in the manner of the embodiments of FIGS. 6 and 7. Specifically, leg rest 15 is kinematically linked to rigid link 120 by means of further link 220 via pivots 230, 235.

The invention claimed is:

1. A seat comprising:

a bottom rest;

a back rest support rotatable relative to the bottom rest about an axis of rotation, the back rest support and bottom rest defining an angle therebetween; and a back rest slidably mounted on the back rest support and moveable therealong to vary its position relative to the bottom rest;

the back rest being kinematically linked to the bottom rest such that the back rest moves nearer to the axis of rotation as the angle between the back rest support and the bottom rest increases.

2. The seat according to claim 1, wherein the back rest is kinematically linked to the bottom rest by a rigid link pivotally attached at a first end to the back rest and at a second end to the bottom rest.

3. The seat according to claim 2, wherein the rigid link is configured to pass underneath the axis of rotation.

4. The seat according to claim 1, wherein the back rest is kinematically linked to the bottom rest by a jointed linkage comprising a lower link, attached at a first end to the bottom rest, and an upper link, pivotally attached at a first end to the back rest and at a second end to a second end of the lower link.

5. The seat according to claim 4, wherein the lower link is kinematically linked to the back rest support and the locking mechanism comprises an adjustable length strut pivotally attached at a first end to the bottom rest and at a second end to the lower link.

6. The seat according to claim 5, wherein the lower link is kinematically linked to the back rest support by a further link pivotally attached at a first end to the lower link and at a second end to an arm rigidly attached to the back rest support and extending radially from said axis of rotation.

7. The seat according to claim 4, wherein the jointed linkage is configured to pass underneath the axis of rotation.

8. The seat according to claim 1 and comprising a locking mechanism configured to releasably fix the angle between the back rest support and the bottom rest.

9. The seat according to claim 8, wherein the locking mechanism comprises an adjustable length strut attached at a first end to the bottom rest and at a second end to the back rest support.

10. The seat according to claim 9, wherein the first end of the adjustable length strut is attached to the bottom rest by a coupling configured to be releasable in the course of normal operation of the seat.

11. The seat according to claim 1 and comprising a leg rest pivotable relative to the bottom rest, the seat being configured to decrease the angle of the leg rest relative to the bottom rest as the angle between the back rest and the bottom rest increases.

12. The seat according to claim 11, wherein the back rest is kinematically linked to the bottom rest by a rigid link pivotally attached at a first end to the back rest and at a second end to the bottom rest and wherein the leg rest is kinematically linked to the rigid link.

13. The seat according to claim 11, wherein the back rest is kinematically linked to the bottom rest by a jointed linkage comprising a lower link, attached at a first end to the bottom rest, and an upper link, pivotally attached at a first end to the back rest and at a second end to a second end of the lower link and wherein the leg rest is kinematically linked to the jointed linkage.

14. A wheelchair comprising a chassis with ground engaging wheels and, mounted thereon, a seat according to claim 1.

15. The wheelchair according to claim 14, wherein the seat is pivotable relative to the chassis.

* * * * *